US005457934A

United States Patent [19]

Lehtola

[11] Patent Number: 5,457,934

[45] Date of Patent: Oct. 17, 1995

[54] BALL DROPPING DEVICE

[75] Inventor: Karl P. Lehtola, Akron, Ohio

[73] Assignee: The Sherwin-Williams Company, Cleveland, Ohio

[21] Appl. No.: 20,520

[22] Filed: Feb. 22, 1993

[51] Int. Cl.[6] ..... B65B 5/10; B65B 39/14

[52] U.S. Cl. ..... 53/250; 53/238; 53/240

[58] Field of Search ..... 53/155, 168, 237, 53/238, 239, 240, 250, 470

[56] References Cited

U.S. PATENT DOCUMENTS

| | | | |
|---|---|---|---|
| 2,685,993 | 8/1954 | Currivan | 53/240 |
| 3,064,406 | 11/1962 | Kennedy | 53/240 |
| 3,283,475 | 11/1966 | Pinto | 53/250 |

FOREIGN PATENT DOCUMENTS

| | | | |
|---|---|---|---|
| 1479288 | 7/1977 | United Kingdom | 53/238 |

*Primary Examiner*—Linda B. Johnson

*Attorney, Agent, or Firm*—Steven W. Tan; James A. Hudak

[57] ABSTRACT

Apparatus for dispensing agitator balls into aerosol cans being transported thereunder is disclosed. The apparatus includes a one or more rotary ball supply heads each receiving agitator balls at its inlet and conveying same to its outlet for dispensing into the aerosol cans. Each ball supply head includes a rotatable inner plate having a plurality of arm members rotatably attached thereto, a spacer member interposed between adjacent arm members, a cover member and an adjustable bar cam which operatively contacts the arms members and rotationally positions same to form a pocket defined by the arm member, spacer member and the inner surface of the cover member for the receipt and retention of an agitator ball as it is being conveyed through the rotary ball supply head.

18 Claims, 6 Drawing Sheets

10
18
16
14
12
19
26
42
40
36
2
2
22
20
30
28
24
42
214
216
34
38
32

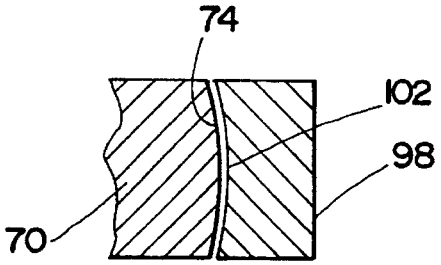
Fig. 5
Fig. 4
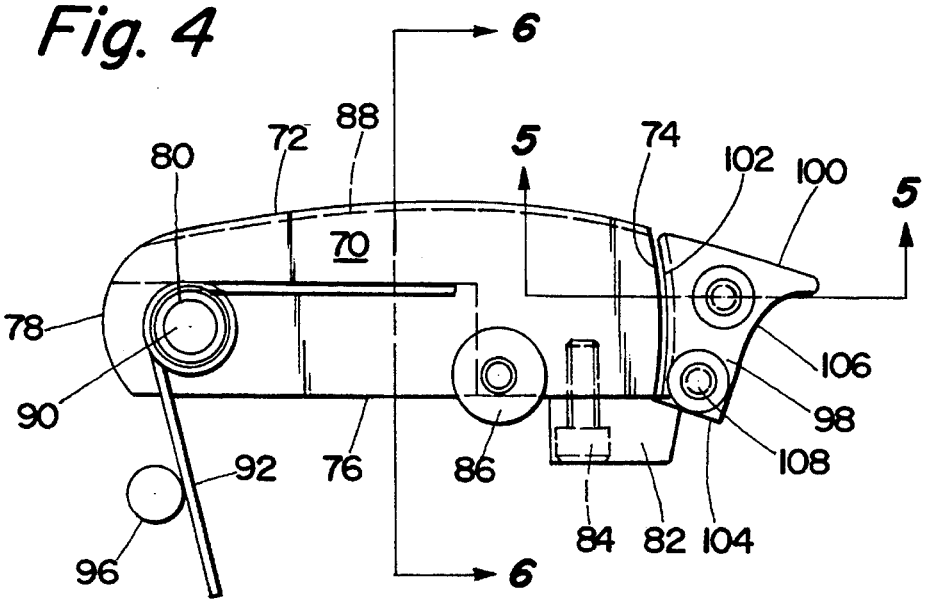
Fig. 6
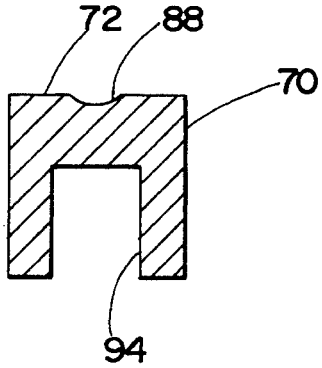

BALL DROPPING DEVICE

TECHNICAL FIELD

The present invention relates, in general, to a device for dropping agitator balls into aerosol cans as the cans are transported by a conveyor and, more particularly, to a ball dropping device that can drop one or more agitator balls of different sizes into aerosol cans and wherein the agitator ball size can be easily changed.

BACKGROUND ART

Various devices are presently available for dropping agitator balls into aerosol cans while the cans are being transported by a conveyor. For example, one design utilizes a horizontally mounted circular plate containing multiple "pockets." This plate rotates over a similarly mounted stationary plate having a plurality of apertures therein. The operating principle utilized by this design is that if an aerosol can passes under the plates when a pocket and an aperture are aligned, an agitator ball can pass therethrough into the aerosol can. The foregoing design has a number of inherent disadvantages since it cannot drop agitator balls of a size other than the size of the "pockets" formed in the plate. If a different size agitator ball is required, the plates must be changed. In addition, this design cannot drop agitator balls which are not perfectly round. Perfectly round agitator balls are typically more expensive than unfinished ball bearings which are generally used for agitator balls.

Another design for a ball dropping device utilizes a trough through which the agitator balls are fed down a tube and into a plastic screw device. By changing the screw device, more than one agitator ball can be dropped into an aerosol can, however, to change ball sizes requires changing the trough, tube and the screw device which entails an inordinate amount of time.

Because of the foregoing inherent disadvantages with presently available ball dropping devices, it has become desirable to develop a ball dropping device which can drop one or more agitator balls of the same or different size into aerosol cans as the cans are transported thereunder on a conveyor.

SUMMARY OF THE INVENTION

The present invention solves the problems associated with the prior art devices and other problems by providing one or more vertically oriented rotary ball supply heads for conveying agitator balls from vibratory feeding devices to aerosol cans being transported by a conveyor under the outlet of each of the supply heads. Each supply head is comprised of an inner plate having a plurality of movable arms positioned adjacent the periphery thereof and a cover having an adjustable bar cam mounted on the inside thereof. As the inner plate rotates, the adjustable bar cam contacts a cam roller on each of the arms causing the arms to be deflected inwardly forming a pocket defined by the curved outer surface of the arm, an adjacent spacer and the inner wall of the cover for the receipt of an agitator ball. The circumferential spacing between the arms is the same as the spacing between the aerosol cans on the conveyor, thus ensuring the accurate placement of an agitator ball in each aerosol can as the cans are transported by the conveyor under the outlets of the rotary ball supply heads. Because of the geometry of the arm and the adjacent spacer which form the pocket in which the agitator ball is received and the fact that the arm is spring loaded, the ball travels in a trajectory as it leaves the outlet of the rotary ball supply head. The foregoing trajectory is very accurate thus ensuring that the agitator ball is received in the aerosol can passing thereunder.

Accordingly, an object of the present invention is to provide an agitator ball dropping device which can supply one or more agitator balls to aerosol cans being transported thereunder on a conveyor.

Another object of the present invention is to provide an agitator ball dropping device which can supply agitator balls of different sizes to aerosol cans being transported thereunder on a conveyor.

A still another object of the present invention is to provide an agitator ball dropping device in which the number of agitator balls being dropped and their respective sizes can be easily changed.

BRIEF DESCRIPTION OF THE DRAWINGS

FIG. 4 is a front elevation view of one of the rotatable arms illustrated in FIG. 3.

FIG. 5 is a cross-sectional view taken across section-indicating lines 5—5 in FIG. 4.

FIG. 6 is a cross-sectional view taken across section-indicating lines 6—6 in FIG. 4.

DESCRIPTION OF THE PREFERRED EMBODIMENT

Figure 1:
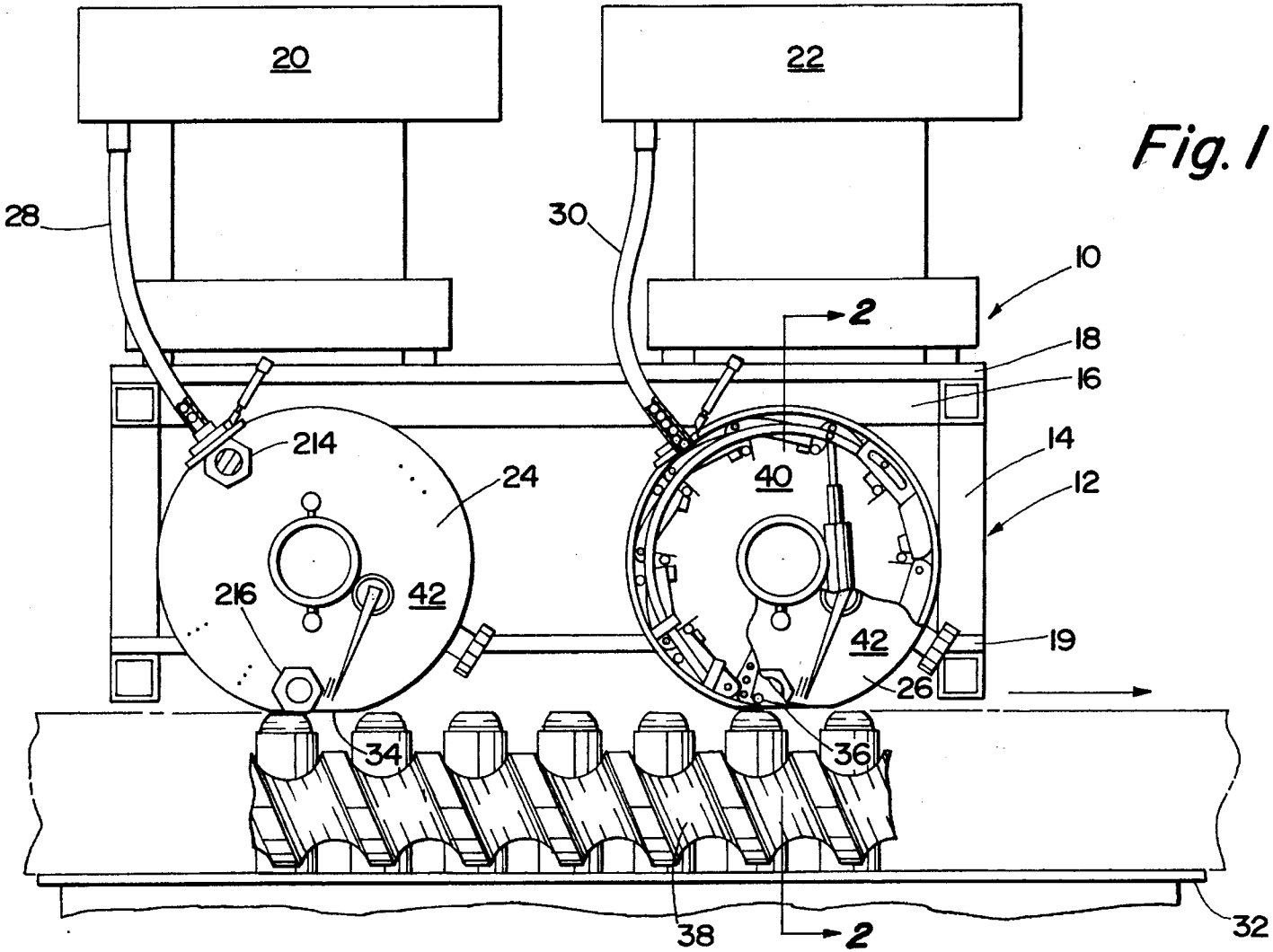
FIG. 1 is a front elevation view, partially broken away in cross-section, of the ball dropping device of the present invention.

Referring now to the drawings where the illustrations are for the purpose of describing the preferred embodiment of the present invention, and are not intended to limit the invention described herein, FIG. 1 is a front elevation view, partially broken away in cross-section, of the ball dropping machine 10 of the present invention. The ball dropping machine 10 includes a frame 12 having a plurality of telescoping upright members 14, cross members 16, a top plate 18 and a middle plate 19. Vibratory feeding devices 20, 22 are mounted to the top plate 18 and respectively supply agitator balls to vertically oriented rotary ball supply heads 24, 26 via tubing 28, 30. The rotary ball supply heads 24, 26 drop agitator balls into the aerosol cans being transported by a conveyor 32 as the cans pass under the respective outlets 34, 36 of supply heads 24, 26. A rotary screw device 38 is positioned adjacent and parallel to the top surface of the conveyor 32 to receive the cans and to maintain proper spacing between same as the cans pass under the rotary ball supply heads 24, 26.

Figure 2:
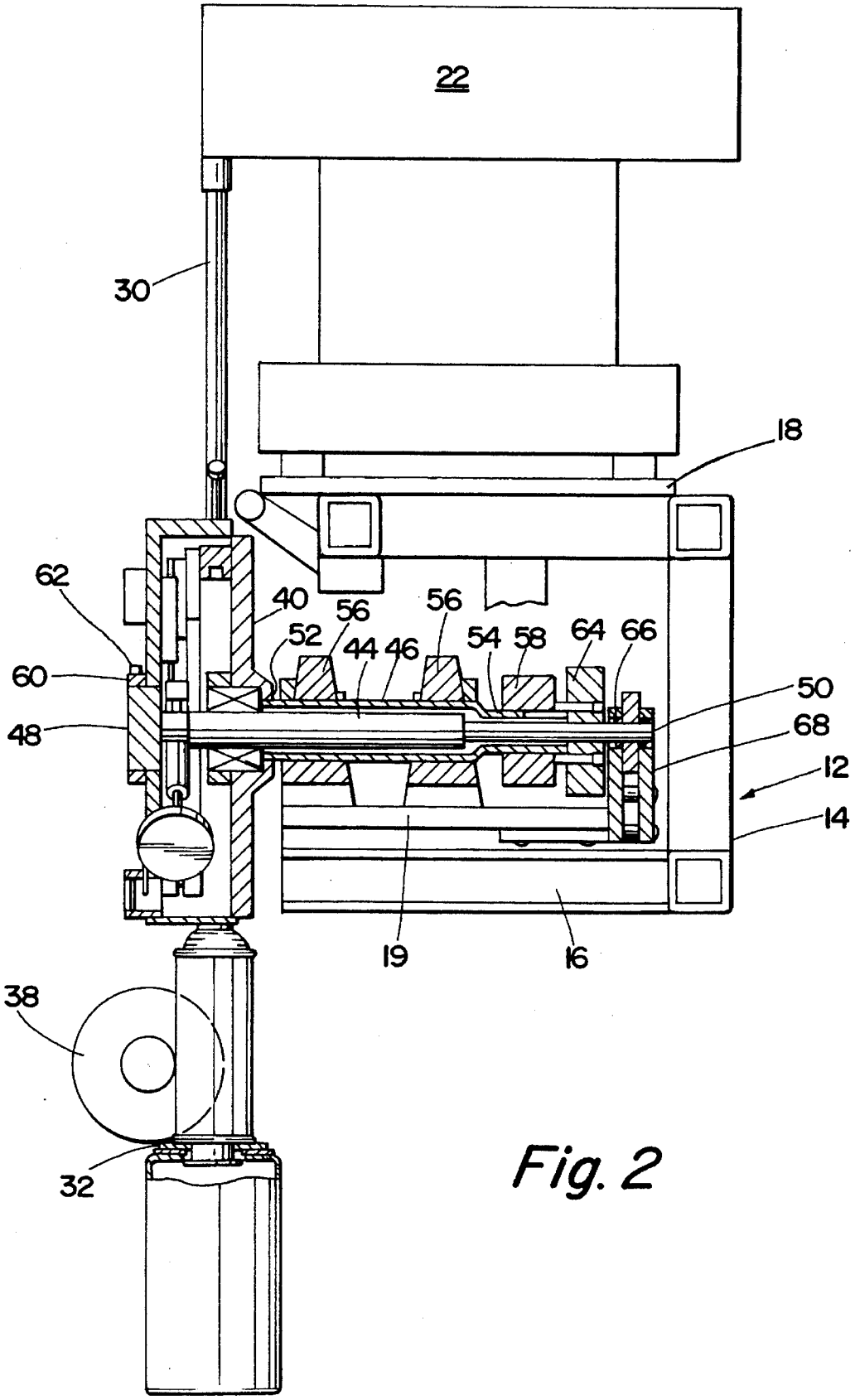
FIG. 2 is a side elevation view, partially broken away in cross-section, of the ball dropping device of FIG. 1.
Figure 3:
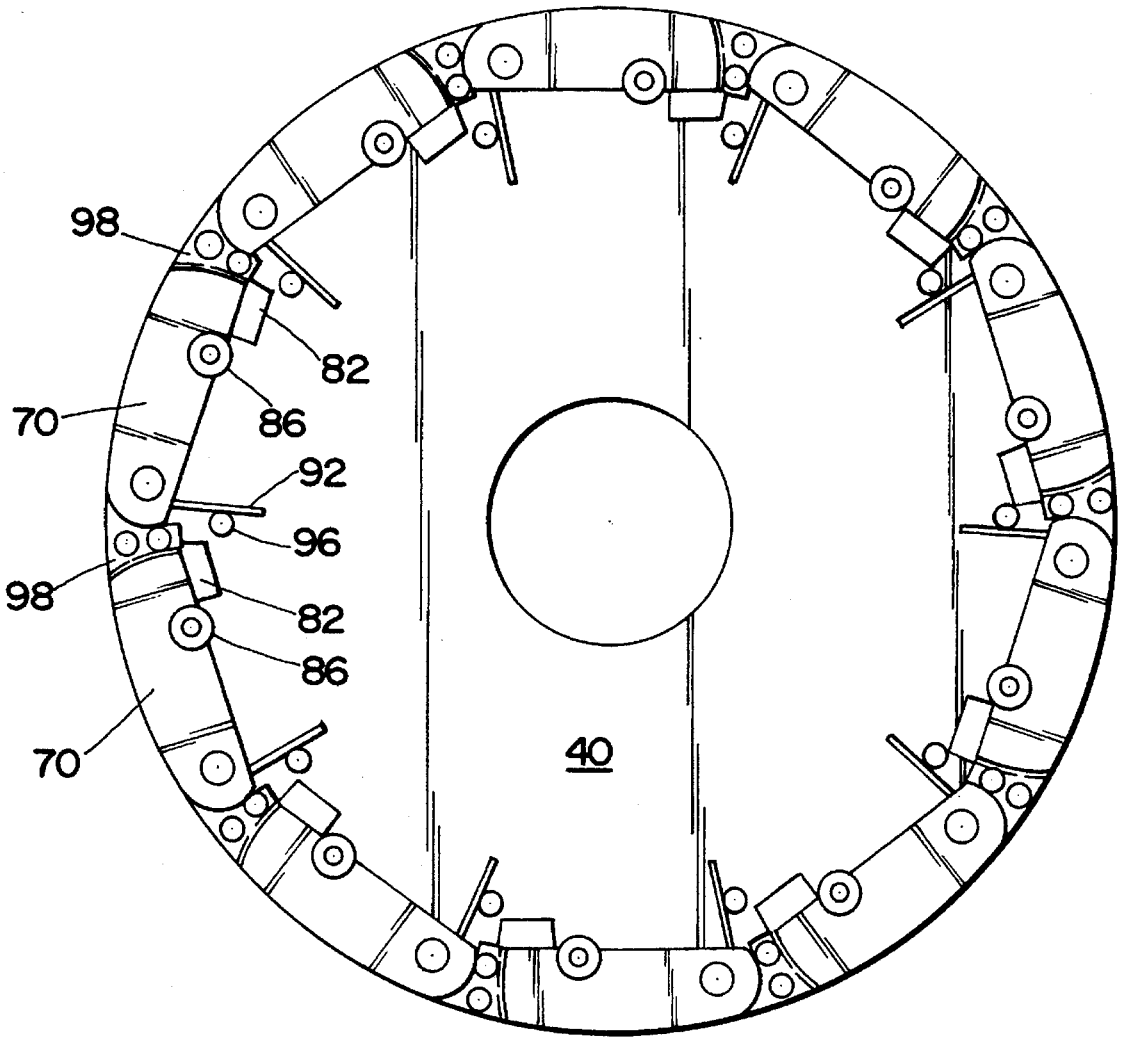
FIG. 3 is a front elevation view of the inner plate utilized by the present invention for conveying agitator balls from the inlet to the outlet of the rotary ball supply head and illustrates the attachment of the rotatable arms thereto.

Each rotary ball supply head 24, 26 includes an inner plate 40 having a generally circular configuration, and a bowl-shaped cover 42 having an inner diameter which approximates the diameter of the inner plate 40. Each rotary ball supply head 24, 26 has an inner shaft 44 which is received within and is substantially concentric with an outer shaft 46, as illustrated in FIG. 2. The ends 48, 50 of inner shaft 44 extend outwardly relative to ends 52, 54, respectively of outer shaft 46. End 52 of outer shaft 46 is connected to the rear of the inner plate 40 and is positioned so as to be in the center thereof. The outer shaft 46 is rotationally supported by one or more pillow block bearings 56 mounted to middle plate 19 of frame 12. The end 54 of the outer shaft 46 is connected to an adjusting device 58, such as an Infinit-Indexer Phase Adjuster Model No. HDI-50 produced by Harmonic Drive Technologies. Adjusting device 58 allows for the independent and tool-less timing adjustment of each rotary supply head 24, 26, as hereinafter described. End 48 of inner shaft 44 is received within a hub 60 provided in the approximate center of cover 42 and is attached to cover 42 by means of pins 62 which are received through apertures provided in hub 60. End 54 of outer shaft 46 is connected to a timing belt pulley 64. End 50 of inner shaft 44 is threadably attached to an adjusting nut 66 mounted to an end plate 68 attached to middle plate 19 of frame 12. In operation, outer shaft 46 and inner plate 40 are allowed to rotate, while inner shaft 44 and cover 42 are held stationary.

A plurality of spring loaded arms 70 are positioned around the periphery of the inner plate 40. As illustrated in FIG. 4, each arm 70 has a curved outer surface 72, a curved end 74, an inner surface 76, an opposite curved end 78, and an aperture 80 positioned adjacent end 78. As shown in FIGS. 4 and 5, curved end 74 is defined by a compound curved surface, i.e., the surface is curved in both the front elevation view (FIG. 4) and in the cross-sectional view illustrated in FIG. 5. Each arm 70 has a stop member 82 attached to its inner surface 76 by a fastener 84 and positioned so as to protrude past end 74. In addition, each arm 70 is provided with a cam roller 86 positioned adjacent to inner surface 76 of the arm. The curved outer surface 72 of each arm 70 is provided with a longitudinally extending groove 88, as illustrated in FIG. 6, which acts as a guide for the travel of the agitator ball as it is received in and transported through the supply head, as hereinafter described. The curved outer surface 72 of arm 70 has a radius of curvature equal to the radius of inner plate 40. Arm 70 is rotationally mounted to inner plate 40 by a pin 90 received through aperture 80. Pin 90 is attached to inner plate 40 and positioned thereon such that the curved outer surface 72 of arm 70 can be rotationally aligned with the curved outer surface of inner plate 40. Each arm 70 is biased rotationally outwardly with respect to inner plate 40 by a spring 92 which is received over pin 90 and positioned thereon so that one end of spring 92 contacts a longitudinally extending pocket 94 formed in inner surface 76 of arm 70 while the other end contacts a pin 96 attached to inner plate 40. The arms 70 are placed around the periphery of inner plate 40 in a spaced-apart relationship separated by a spacer 98 which is interposed between each pair of adjacent arms 70. The circumferential spacing between arms 70 equals the spacing between the cans on the conveyor 32. Each spacer 98 has a curved outer surface 100, a curved end 102, an inner surface 104, and an opposite curved end 106. Curved outer surface 100 has a radius of curvature equal to that of curved outer surface 72 of arm 70 and to the radius of inner plate 40; curved end 102 has a configuration complementary to that of curved end 74 of arm 70, i.e., curved end 102 is also defined by a compound-curved surface; and curved end 106 has a configuration complementary to that of curved end 78 of arm 70. Inner surface 104 limits the outwardly directed rotation of arm 70 by contacting member 82 thereon which acts as a mechanical stop. Each spacer 98 is affixed to the surface of inner plate 40 by means of fasteners 108.

Figure 7:
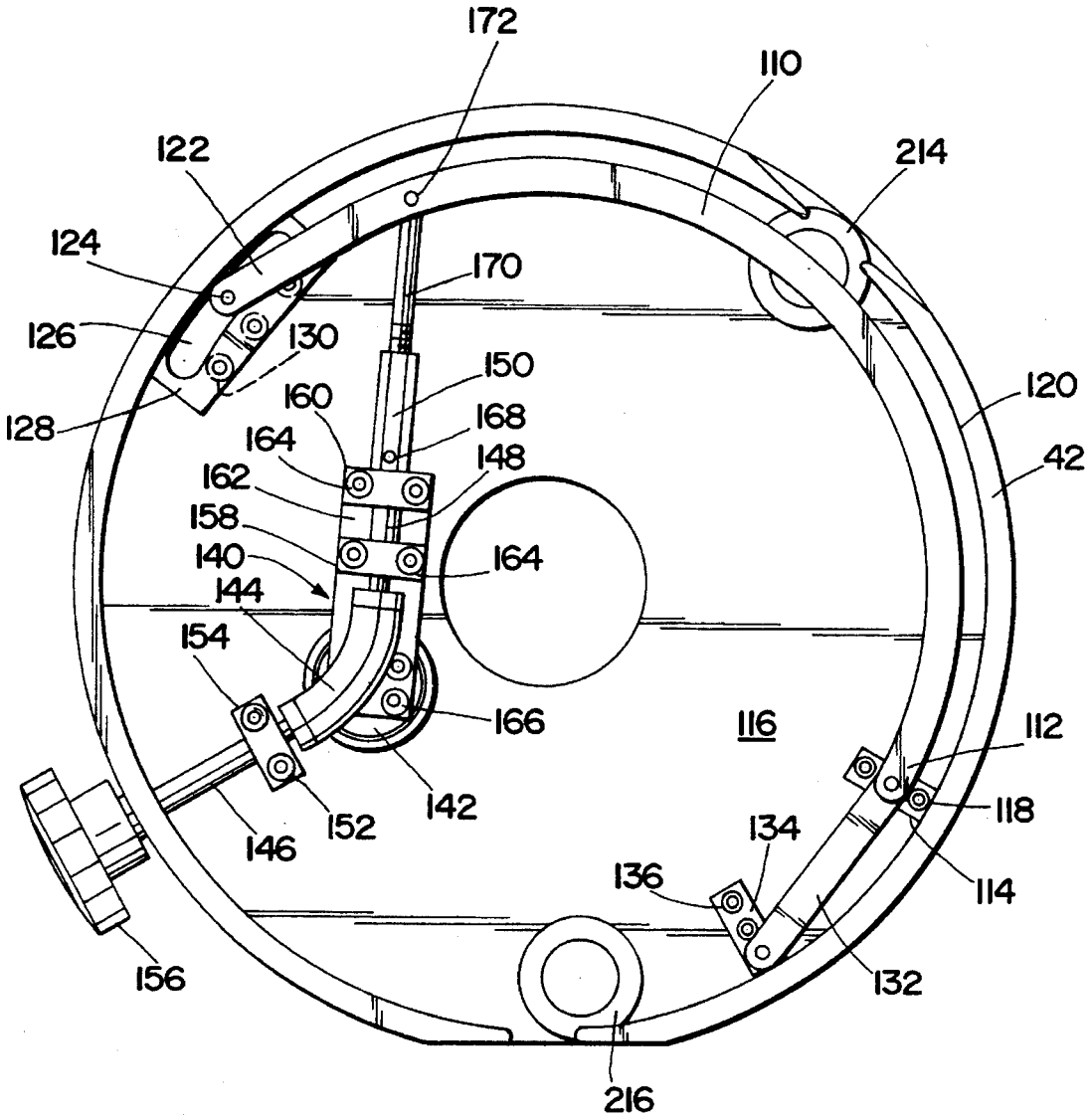
FIG. 7 is a front elevation view of the interior of the bowl-shaped cover for the rotary ball supply head and illustrates the adjustable bar cam and the device for adjusting same.

Referring now to FIG. 7, the interior of the bowl-shaped cover 42 is illustrated. Received within cover 42 is an adjustable bar cam 110 having a radius substantially concentric with the inner radius of cover 42 and the radius of the inner plate 40. One end 112 of adjustable bar cam 110 is pivotally attached to a spacer block 114 which is attached to the inner surface 116 of cover 42 by fasteners 118 causing adjustable bar cam 110 to be in a spaced-apart relationship to both the inner surface 116 and inner wall 120 of cover 42. The other end 122 of adjustable bar cam 110 has a cam follower 124 attached thereto which is received within a curved elongated slot 126 provided in a bracket 128 that is attached to the inner surface 116 of cover 42 by fasteners 130. A trailing bar cam 132 is attached at one end to end 112 of adjustable bar cam 110 and at the other end to a spacer block 134 which is attached to the inner surface 116 of cover 42 by fasteners 136.

Figure 8:
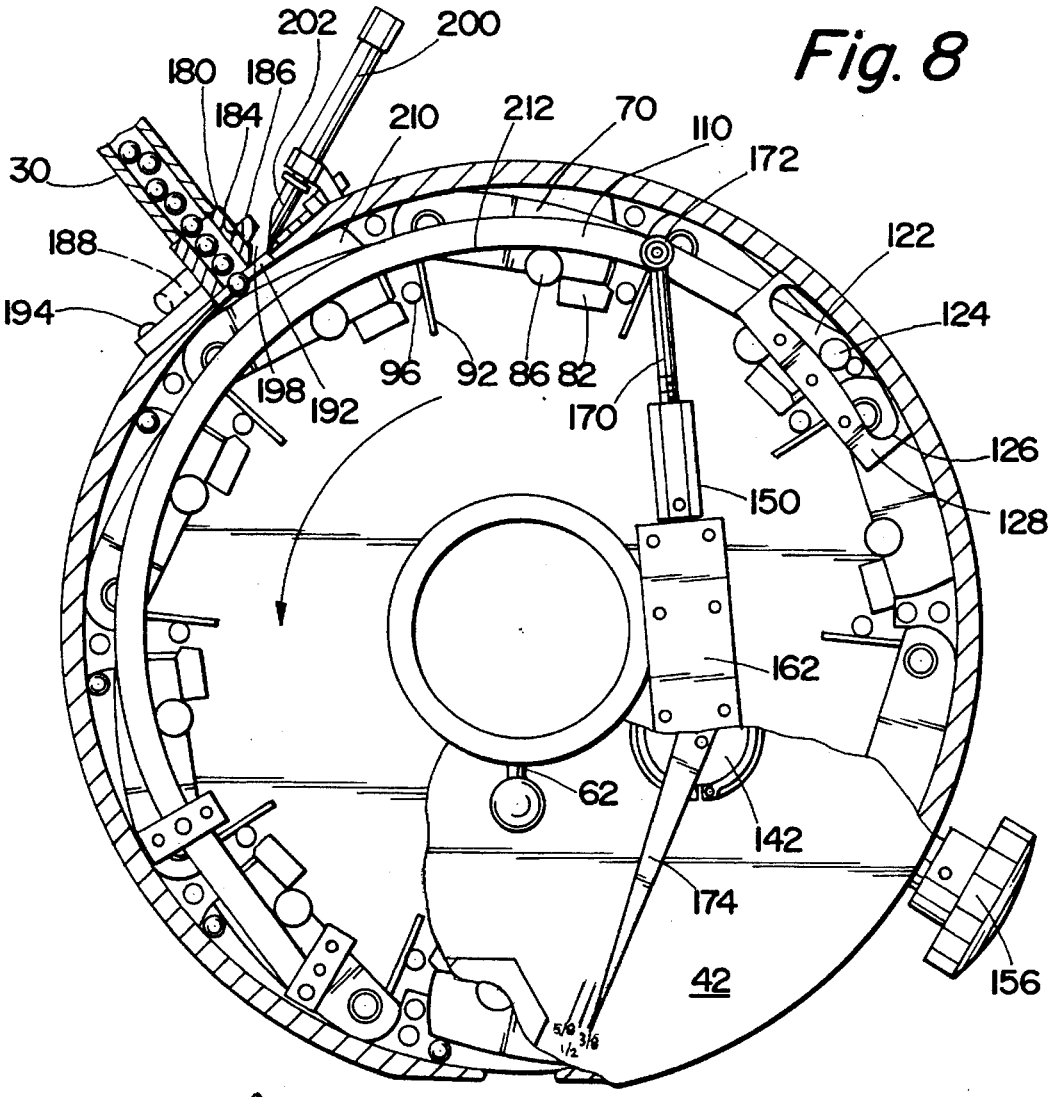
FIG. 8 is a front elevation view, partially broken away in cross-section, of the rotary ball supply head of the ball dropping device of the present invention and illustrates the attachment of the tubing from the vibrating feeding device to the rotary ball supply head.

An adjustment device, shown generally by the numeral 140, is received within cover 42 and is used to vary the position of the adjustable bar cam 110. The adjustment device 140 includes a cam pivot shaft 142 received through cover 42, a helical universal joint 144, an adjusting shaft 146 connected to one end of helical universal joint 144, an adjusting shaft 148 connected to the opposite end of universal joint 144, and an adjusting nut 150. Adjusting shaft 146 is mounted for rotation within spacer block 152 which is attached to the inner surface 116 of cover 42 by fasteners 154. The other end of adjusting shaft 146 is connected to a knob 156 positioned outside the cover 42. Adjusting shaft 148 is mounted for rotation within a pair of spaced-apart spacer blocks 158, 160 which are attached to a plate 162 by fasteners 164. Plate 162 is attached to cam pivot shaft 142 by fasteners 166. The opposite end of adjusting shaft 148 is received within one end of adjusting nut 150 and is attached thereto by a pin 168 which is received through an aperture in adjusting nut 150 and adjusting shaft 148. One end of a latch bolt 170 is threadably received in the opposite end of adjusting nut 150. The opposite end of latch bolt 170 is connected to the adjustable bar cam 110 by a fastener 172 located adjacent bracket 128. A pointer 174, as illustrated in FIG. 8, is attached to the cam pivot shaft 142 and is located exteriorly of the cover 42. Graduations and/or indicia are provided adjacent the end of pointer 174 to indicate the "pocket depth" for receipt of the agitator balls to be placed in the aerosol cans, as hereinafter described. Rotation of knob 156 causes latch bolt 170 to be threadably advanced in or withdrawn from adjusting nut 150 causing the adjustable bar cam. 110 to pivot about its end 112 and to move radially inwardly or outwardly relative to the inner wall 120 of cover 42. Since adjusting shaft 148 is mounted for rotation to plate 162 which is attached to cam pivot shaft 142, advancement or withdrawal of latch bolt 170 from adjusting nut 150 also causes cam pivot shaft 142 and pointer 174 to rotate relative to the graduations or indicia provided adjacent thereto on cover 42.

Figure 9:
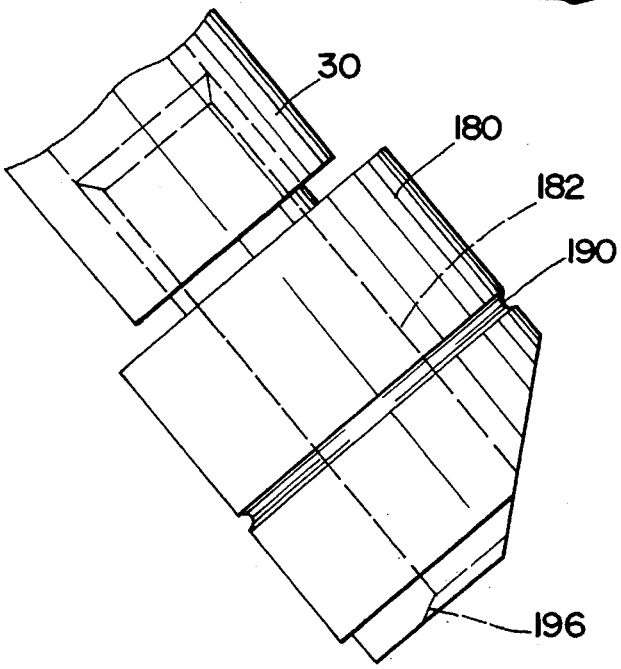
FIG. 9 illustrates the tube end holder utilized to attach the tubing from the vibrating feeding device to the tube end fitting attached to the rotary ball supply head.

Referring now to FIGS. 8 and 9, the attachment of the tubing 30 from vibratory feeding device 22 to the inlet to rotary ball supply head 26 is illustrated. It is understood that the following discussion also applies to rotary ball supply head 24. Tubing 30 from rotary ball supply head 26 is connected to the end of a tube end fitting 180 having a bore 182 therethrough with a diameter that is substantially the same as the inner diameter of tubing 30. Tube end fitting 180, with tubing 30 attached thereto, is received within the bore 184 of a tube end holder 186 and is retained therein by a spring pin 188 which passes through the collar portion of tube end holder 186. End of spring pin 188 is received in a circumferential detent 190 provided in the outer surface of tube end fitting 180. The bore 182 within tube end fitting 180 is aligned with the inlet 192 to the rotary ball supply head 26 and the flange portion of tube end holder 186 is fastened to the cover 42 by fasteners 194. The end of tube end fitting 180 has a chamfer 196 thereon adjacent bore 182. The collar portion of tube end holder 186 and the adjacent wall portion of tube end fitting 180 have an angularly oriented aperture 198 therein adjacent bore 182. An air cylinder 200 having a tip 202 receivable in angularly oriented aperture 198 is mounted exteriorly of tube end holder 186 and rotary ball supply head 26. As agitator balls travel downwardly through the tubing 30 from the vibratory feeding device 22, they pass into the rotary ball supply head 26 via inlet 192. Each arm 70 acts as the conveying means for a single agitator ball from the inlet to the outlet of the rotary ball supply head. In essence, each arm 70 cooperates with adjacent components to form a pocket in which the ball is received and conveyed to the outlet 36 of the rotary ball supply head 26. The pocket, shown generally by the numeral 210, is defined by curved outer surface 72 of arm 70, curved end 102 of adjacent spacer 98 and inner wall 120 of cover 42. The depth of pocket 210 can be set by rotating knob 156 causing latch bolt 170 to be threadably advanced or withdrawn from adjusting nut 150 which, in turn, causes adjustable bar cam 110 to pivot about its end 112. Since cam roller 86 on arm 70 is contacted by the inner surface 212 of adjustable bar cam 110, movement of adjustable bar cam 110 about its end 112 causes radial movement of arm 70 about pin 90. In this manner, the "depth" of pocket 210 can be "set", and the size of the balls to be received within the pocket 210 can be indicated by the graduations or indicia provided adjacent the end of pointer 174. A sight glass 214 is provided in cover 42 adjacent inlet 192 so that the orientation of the agitator ball as it is received in the pocket 210 can be readily seen without removing the cover 42 from the rotary ball supply head 26. Similarly, a sight glass 216 is provided in cover 42 adjacent outlet 36 so that the orientation of the agitator ball as it exits the pocket 210 can be similarly observed.

Operationally, the circumferential speed of inner plate 40 is synchronized with the linear speed of the aerosol cans in the rotary screw device 38 so that a pocket 210 is aligned with the outlet 36 of rotary ball supply head 26 when an aerosol can is directly thereunder. In this manner, each rotary ball supply head 24 and 26 can supply a different size agitator ball to each of the cans being transported by the conveyor 32. Regardless of whether each rotary supply head 24 and 26 is supplying the same size or different size agitator balls to each aerosol can being transported by conveyor 32 under their respective outlets 34 and 36, each of the rotary ball supply heads 24 and 26 operates in the same manner with respect to transporting an agitator ball from its inlet to its respective outlet.

Agitator balls are available in various sizes and are formed from various materials, such as steel or glass. Steel agitator balls are typically unfinished ball bearings and generally have two oppositely disposed flat surfaces thereon. Assuming that a steel agitator ball is to be supplied to the aerosol cans being transported by the conveyor 32, the pocket 210 for transporting the ball is "set" by receiving a ball from the vibratory feeding device 22 via tubing 30 to the inlet 192 to the rotary ball supply head 26. The ball is received in the pocket 210 and inner plate 40 and outer shaft 46 connected thereto are manually rotated allowing the ball to roll down the longitudinally extending groove 88 in curved outer surface 72 of arm 70 until it contacts curved end 102 of adjacent spacer 98. Knob 156 is then rotated so that the height of the agitator ball in pocket 210 can be adjusted. Pocket depth is "set" such that if one of the flat surfaces on the ball was contacting curved outer surface 72 of arm 70, its oppositely disposed flat surface would just contact the inner wall 120 of cover 42 upon rotation of inner plate 40. In essence, in this orientation, the ball is totally received within the pocket 210 and no portion of the ball is within inlet 192. In this manner, when a ball enters the pocket 210 in any position other than "flat surface first", which is almost always the case, the arm 70 will be directed radially inwardly, thus allowing chamfer 196 on the end of tube end fitting 180 to urge the ball into the pocket 210 as inner plate 40 rotates. Thus, each agitator ball will always be firmly received within a pocket 210. After the pocket depth has been "set", all of the other arms 70 attached to the inner plate 40 are similarly "set" and will have the same "depth" as they pass under inlet 192 since such depth is determined by the position of the adjustable bar cam 110 whose inner surface 212 contacts the cam roller 86 on each arm 70 as the inner plate 40 is rotated.

In operation, as the inner plate 40 and outer shaft 46 rotate in the counterclockwise direction, an agitator ball from the vibratory feeding device 22 passes through tubing 30 into the inlet 192 of rotary ball supply head 26 and is permitted to roll within longitudinally extending groove 88 in the curved outer surface 72 of arm 70. The agitator ball contacts curved end 102 of adjacent spacer 98 and is transported within the pocket 210 along-the inner wall 120 of cover 42 to the outlet 36 of rotary ball supply head 26. Spacer 98 prevents the entry of a second agitator ball into the pocket 210. As the inner plate 40 rotates, an agitator ball is received in each pocket 210 defined by the curved outer surface 72 of each arm 70, curved end 102 of adjacent spacer 98 and the inner wall 120 of cover 42. Each agitator ball traverses a path around the inner wall 120 of cover 42 wherein the radial position of its associated arm 70 is controlled by the contact of its associated cam roller 86 against the inner surface 212 of adjustable bar cam 110. After the agitator ball has passed the end of trailing bar cam 132, its associated arm 70 is restrained only by the agitator ball and cover 42. When the agitator ball reaches the outlet 36 of rotary ball supply head 26, its associated arm 70 pivots radially outwardly causing the agitator ball to assume a trajectory defined by the curve of the curved end 102 of spacer 98 against which it had been riding. The foregoing trajectory has a horizontal component in the direction of travel of the aerosol can and a vertical component toward the conveyor 32. By synchronizing the circumferential speed of the inner plate 40 with the linear speed of the aerosol cans in rotary screw device 38, an accurate trajectory can be established wherein the agitator ball will be received in the middle of the opening to the aerosol can. Tests have been conducted which have shown that the foregoing device is extremely accurate and can be operated at conveyor speeds substantially greater than if the agitator ball was merely "dropped" into the aerosol can, as in the prior art devices. This improvement is the result of the balls being "forced" out of the pocket 210 associated with arm 70. For example, conveyor lines have been run at a speed in excess of 300 cans per minute with minimal problems. There is no reason that significantly higher speeds cannot be achieved.

If, for some reason, an aerosol can is missing on the conveyor 32, detection devices are present on the conveyor 32 which cause air cylinder 200 to be actuated resulting in tip 202 immediately entering angularly oriented aperture 198 in tube end holder 186 and tube end fitting 180 preventing an agitator ball from entering the inlet 192 to rotary ball supply head 26, and thus, preventing an agitator ball from entering the pocket 210 which would coincide with the location of the missing aerosol can on the conveyor. When the detection device indicates that an aerosol can is present, the air cylinder 200 is deactuated causing tip 202 to be withdrawn through angularly oriented aperture 198 permitting the agitator balls to again pass into inlet 192 to rotary ball supply head 26.

The selection of whether a single agitator ball or two agitator balls will be dropped into each aerosol can is effected through actuation of a selector switch (not shown) mounted to the frame 12 of the machine 10. If one agitator ball per aerosol can is desired, the selector switch is set for a single ball per can and only one rotary ball supply head is operated; if two agitator balls per can are desired, the selector switch is set for two balls per can and both rotary ball supply heads are operated. Thus, the machine 10 can be changed from supplying one agitator ball per aerosol can to two agitator balls per can by merely actuating the selector switch, and no tools are required to effect the foregoing change. From the foregoing, it is apparent that the task of dropping agitator balls of different size into each can is also extremely simple. In this case, one rotary ball supply head would be operated with agitator balls of one size while the second rotary ball supply head would be operated with agitator balls of another size.

The ball dropping machine 10 will be driven directly from the filler for the aerosol cans so as to minimize any problems in timing between the rotary ball supply heads and the filler. The height of the rotary ball supply heads 24, 26 relative to the conveyor 32 can be readily changed to accommodate aerosol cans of a different height by actuation of screw driven hydraulic cylinders (not shown) which are connected to the telescoping upright members 14. In this manner, the height of the rotary ball supply heads 24, 26 with respect to the aerosol cans being transported thereunder on conveyor 32 can be easily "set." If a "jam" occurs under one or both of the rotary ball supply heads 24, 26, the heads can be readily raised by the foregoing screw driven hydraulic cylinders permitting the easy removal of the "jam." In the event a "jam" occurs within either of the rotary ball supply heads 24, 26, an overload clutch (not shown) associated with same can be engaged or disengaged allowing the aforementioned selector switch to be actuated permitting the ball dropping machine 10 to operate such that a single agitator ball is dropped into each aerosol can by the remaining operable rotary ball supply head. In this manner, the "jam" within the inoperable rotary ball supply head can be easily removed while the machine continues to operate, thus minimizing machine "downtime."

An intrinsically safe photo-electric sensor (not shown) is provided adjacent tube end fitting 180 to monitor the presence of agitator balls in tubing 30. The lack of balls in tubing 30 causes a gate (not shown) to be actuated preventing aerosol cans from entering rotary screw device 38. When balls are again present in tubing 30, the aforementioned gate is deactuated permitting aerosol cans to again enter rotary screw device, Similarly, an intrinsically safe photo-electric sensor (not shown) is provided adjacent outlet 36 of rotary ball supply head 26. If the sensor detects that an agitator ball was not dispensed into an aerosol can as it passed under the outlet 36 of rotary ball supply head 26, an ejector device (not shown) provided downstream of rotary ball supply head 26 is actuated removing the subject aerosol can from the conveyor 32. Thus, under either of the foregoing conditions, the rotary ball supply heads 24, 26, rotary screw device 38 and conveyor 32 continue to operate minimizing machine "downtime."

Certain modifications and improvements will occur to those skilled in the art upon reading the foregoing. It should be understood that all such modifications and improvements have been deleted herein for the sake of conciseness and readability, but are properly within the scope of the following claims.

I claim:

1. Apparatus for dispensing agitator balls into aerosol cans comprising a frame member, and means for dispensing the agitator balls having an inlet for receiving the agitator balls and an outlet for dispensing the agitator balls into the aerosol cans, said dispensing means comprising a plate member mounted for rotation to said frame member, a cover member and at least one arm member rotatably mounted to said plate member permitting rotation of said arm member in a plane substantially parallel to the plane of said plate member, said arm member cooperating with said plate member and said cover member forming a pocket for the receipt of an agitator ball and the retention of the agitator ball against said cover member as said plate member is rotated resulting in the conveyance of the agitator ball from said inlet to said outlet of said dispensing means.

2. The apparatus as defined in claim 1 wherein said arm member is rotatably mounted to said plate member adjacent the periphery of said plate member.

3. The apparatus as defined in claim 2 further including means for rotationally biasing said arm member relative to said plate member.

4. The apparatus as defined in claim 1 further including a spacer member mounted to said plate member and positioned relative to said arm member to provide a surface which defines said pocket for the receipt and retention of the agitator ball as the agitator ball is conveyed from said inlet to said outlet of said dispensing means.

5. The apparatus as defined in claim 1 further including means for rotationally positioning said arm member relative to said plate member.

6. The apparatus as defined in claim 5 wherein said positioning means comprises a cam member which operatively contacts said arm member resulting in the rotation of said arm member relative to said plate member as said plate member rotates.

7. The apparatus as defined in claim 6 further including a cam roller operatively connected to said arm member, said cam roller contacting said cam member resulting in the rotation of said arm member relative to said plate member as said plate member rotates.

8. The apparatus as defined in claim 6 wherein said cam member is pivotally attached to said cover member and positioned adjacent the inner surface of said cover member.

9. The apparatus as defined in claim 6 further including means for adjusting the position of said cam member relative to said plate member.

10. The apparatus as defined in claim 1 wherein said arm member has a longitudinally extending recess therein to guide the agitator ball within said pocket.

11. The apparatus as defined in claim 1 further including means for controlling the admittance of agitator balls into said dispensing means, said controlling means including an actuatable gate positioned adjacent to said inlet to said dispensing means.

12. The apparatus as defined in claim 11 wherein said controlling means includes means for urging the agitator balls into said pocket.

13. The apparatus as defined in claim 1 wherein said dispensing means is oriented in a substantially vertical plane.

14. Apparatus for dispensing agitator balls into aerosol cans comprising a frame member; means for dispensing the agitator balls having an inlet for receiving the agitator balls and an outlet for dispensing the agitator balls into the aerosol cans, said dispensing means comprising a plate member mounted for rotation to said frame member, a cover member and at least one arm member rotatably mounted to said plate member permitting rotation of said arm member in a plane substantially,parallel to the plane of said plate member; means for rotationally positioning said arm member relative to said plate member; and a spacer member mounted to said plate member and cooperating with said arm member to form a pocket for the receipt of an agitator ball and the retention of the agitator ball against said cover member as said plate member is rotated resulting in the conveyance of the agitator ball from said inlet to said outlet of said dispensing means.

15. The apparatus as defined in claim 14 wherein said positioning means comprises a cam member which operatively contacts said arm member resulting in the rotation of said arm member relative to said plate member.

16. The apparatus as defined in claim 15 further including a cam roller operatively connected to said arm member, said cam roller contacting said cam member resulting in the rotation of said arm member relative to said plate member as said plate member rotates.

17. The apparatus as defined in claim 15 wherein said cam member is pivotally attached to said cover member and positioned adjacent the inner surface of said cover member.

18. The apparatus as defined in claim 15 further including means for adjusting the position of said cam member relative to said plate member.

* * * * *